US007194974B2

(12) United States Patent
Kamio

(10) Patent No.: US 7,194,974 B2
(45) Date of Patent: Mar. 27, 2007

(54) STEERING DEVICE OF PERSONAL WATERCRAFT

(75) Inventor: Kunihiko Kamio, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 42 days.

(21) Appl. No.: 11/202,625

(22) Filed: Aug. 11, 2005

(65) Prior Publication Data

US 2006/0037524 A1 Feb. 23, 2006

(30) Foreign Application Priority Data

Aug. 20, 2004 (JP) ..... 2004-240437

(51) Int. Cl.
*B63H 25/10* (2006.01)
*B63B 35/73* (2006.01)

(52) U.S. Cl. ..... 114/144 R; 114/55.52

(58) Field of Classification Search ..... None
See application file for complete search history.

(56) References Cited

U.S. PATENT DOCUMENTS 4,903,627 A * 2/1990 Nakamura ..... 114/55.52

FOREIGN PATENT DOCUMENTS

JP 61-275095 12/1986

* cited by examiner

*Primary Examiner*—Jesus Sotelo
*Assistant Examiner*—Daniel Venne
(74) *Attorney, Agent, or Firm*—Alleman Hall McCoy Russell & Tuttle LLP

(57) ABSTRACT

A steering device of a personal watercraft is disclosed. The steering device typically includes a lower steering column that is mounted to a body of the watercraft and is configured to be rotatable around a rotational axis extending rearward and upward, and an upper steering column that is configured to support a steering handle and is movably coupled to the lower steering column. The upper steering column is movable close to and away from the lower steering column along a straight line extending to be inclined rearward with respect to the rotational axis of the lower steering column.

3 Claims, 5 Drawing Sheets

STEERING DEVICE OF PERSONAL WATERCRAFT

BACKGROUND OF THE INVENTION

1. Field of the Invention

The present invention generally relates to a steering device equipped in a personal watercraft. More particularly, the present invention relates to a steering device that is capable of changing the position of a steering handle in a direction to be inclined rearward with respect to a rotational axis of a steering column.

2. Description of the Related Art

When several riders share one personal watercraft, the position of a steering handle may vary depending on their physical sizes or preferences. In addition, the position of the steering handle may vary depending on an attitude of the rider, for example, a standing position and a kneeling position. When a small rider rides in a watercraft or a rider steers in the kneeling position, the steering handle is suitably positioned relatively lower, while when a large rider rides in the watercraft or a rider steers in the standing position, the steering handle is suitably positioned relatively higher. To this end, there has been disclosed a personal watercraft equipped with a steering device capable of changing a position of a steering handle along a rotational axis of a steering column that supports the steering handle at an upper end portion thereof (see. Japanese. Laid-Open Patent Application Publication No. Sho. 61-275095).

In the steering device of the personal watercraft disclosed in Patent Application Publication No. Sho. 61-275095, since the steering handle is movable, i.e., extendable and retractable along the rotational axis of the steering column, a movement amount of the steering handle in a longitudinal direction of the watercraft is small relative to a movement amount of the steering handle in a vertical direction. If the steering handle is extended along the axis of the steering column and fixed to an upper side of the rotational axis of the steering column, the steering handle is located forward of a desired position when a large rider rides in the watercraft or a rider steers in a standing position. As a result, the rider is forced to tilt his or her body forward to steer the steering handle.

SUMMARY OF THE INVENTION

The present invention addresses the above described conditions, and an object of the present invention is to provide a steering device of a personal watercraft that enables a steering handle to be movable in a direction to be inclined rearward with respect to a rotational axis of a steering column in order to increase a movement amount of the steering handle in a longitudinal direction of the watercraft, thereby allowing a rider to steer the steering handle in a suitable attitude.

According to the present invention, there is provided a steering device of a personal watercraft comprising a lower steering column that is mounted to a body of the watercraft and is configured to be rotatable around a rotational axis extending rearward and upward; and an upper steering column that is configured to support a steering handle and is movably coupled to the lower steering column; wherein the upper steering column is movable close to and away from the lower steering column along a straight line extending to be inclined rearward with respect to the rotational axis of the lower steering column.

With such a construction, the upper steering column is movable in the direction to be inclined rearward with respect to the rotational axis of the lower steering column depending on the rider's size. As a result, the steering handle is suitably positioned to enable the rider to steer the handle in a natural attitude.

One of the upper steering column and the lower steering column may be provided with an elongate guide hole configured to open in a lateral direction of the watercraft and to extend along the straight line extending to be inclined rearward with respect to the rotational axis of the lower steering column, and an opposite steering column may be provided with a protruding portion configured to be guided along the straight line in engagement with the elongate guide hole. One of the upper steering column and the lower steering column may be provided with a worm screw rotatably attached thereto, the worm screw being rotatable around a rotational axis extending substantially in parallel with the straight line extending to be inclined rearward with respect to the rotational axis of the lower steering column, and an opposite steering column may be provided with a worm rack configured to extend along the straight line and to mesh with the worm screw.

In such a construction, by rotating the worm screw, the upper steering column easily moves in a predetermined direction relative to the lower steering column.

The steering device may further comprise a column cover configured to cover the upper steering column; and a grip attached to an end portion of a shaft portion which is located outside the column cover, the shaft portion extending from the worm screw to outside the column cover along the rotational axis of the worm screw, the grip being configured to be rotated integrally with the worm screw to cause the upper steering column to be movable close to and away from the lower steering column.

In such a construction, the rider rotates the grip to cause the worm screw to rotate, enabling the steering handle to be positioned freely according to the rider's size.

The above and further objects and features of the invention will more fully be apparent from the following detailed description with accompanying drawings.

DETAILED DESCRIPTION OF THE PREFERRED EMBODIMENTS

Figure 1:
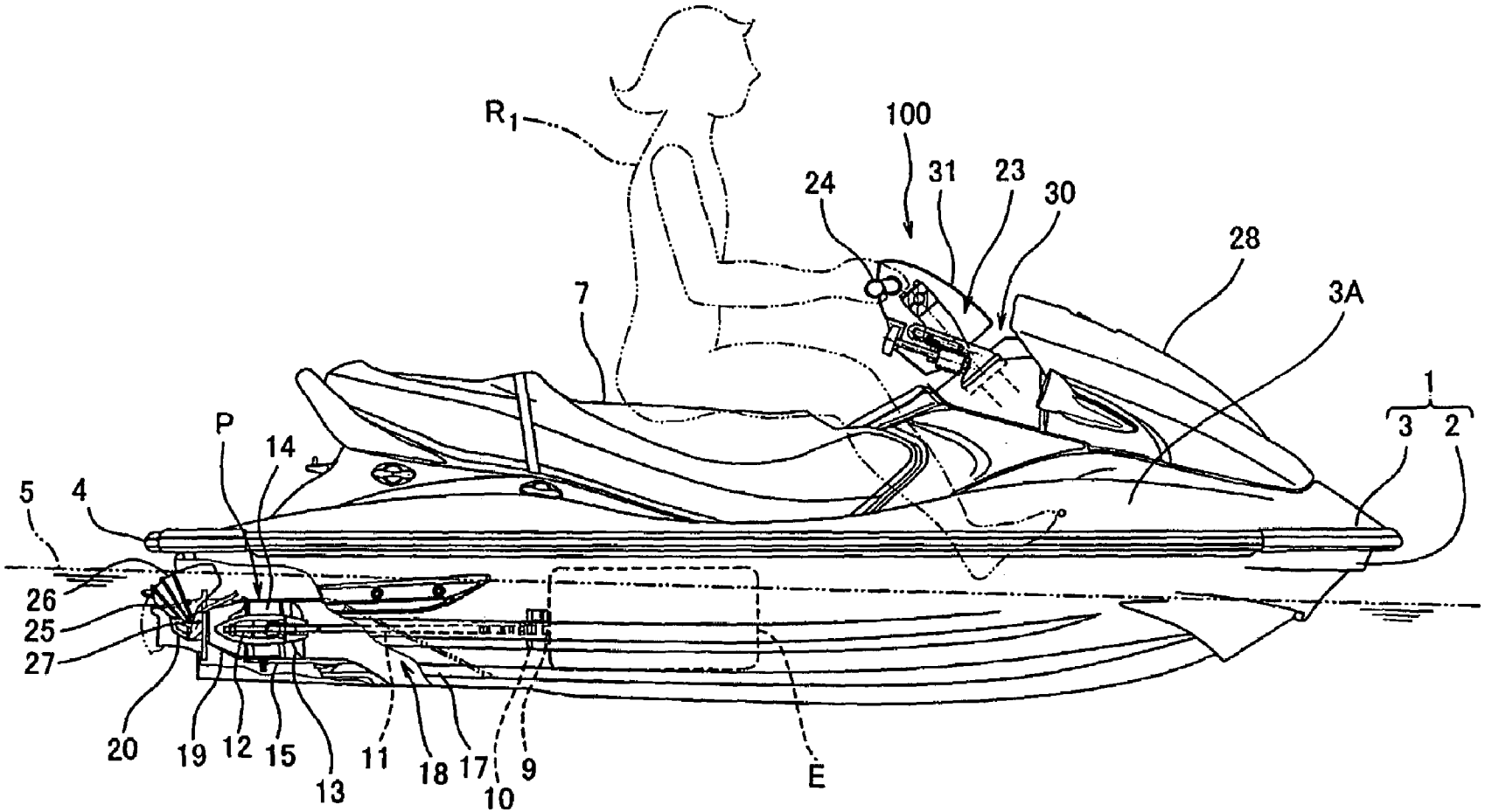
FIG. 1 is a side view of a personal watercraft according to an embodiment of the present invention, showing a retracted state of a steering column and a steering attitude of a rider.

Hereinafter, an embodiment of a steering device of a personal watercraft of the present invention will be described with reference to the accompanying drawings. Turning now to FIG. 1, a straddle-type personal watercraft is shown to be equipped with a seat 7 straddled by a rider R1. A body 1 of the watercraft includes a hull 2 and a deck 3 covering the hull 2 from above. A line at which the hull 2 and the deck 3 are connected over the entire perimeter thereof is called a gunnel line 4. In FIG. 1, the gunnel line 4 is located above a waterline 5 of the personal watercraft.

Figure 2:
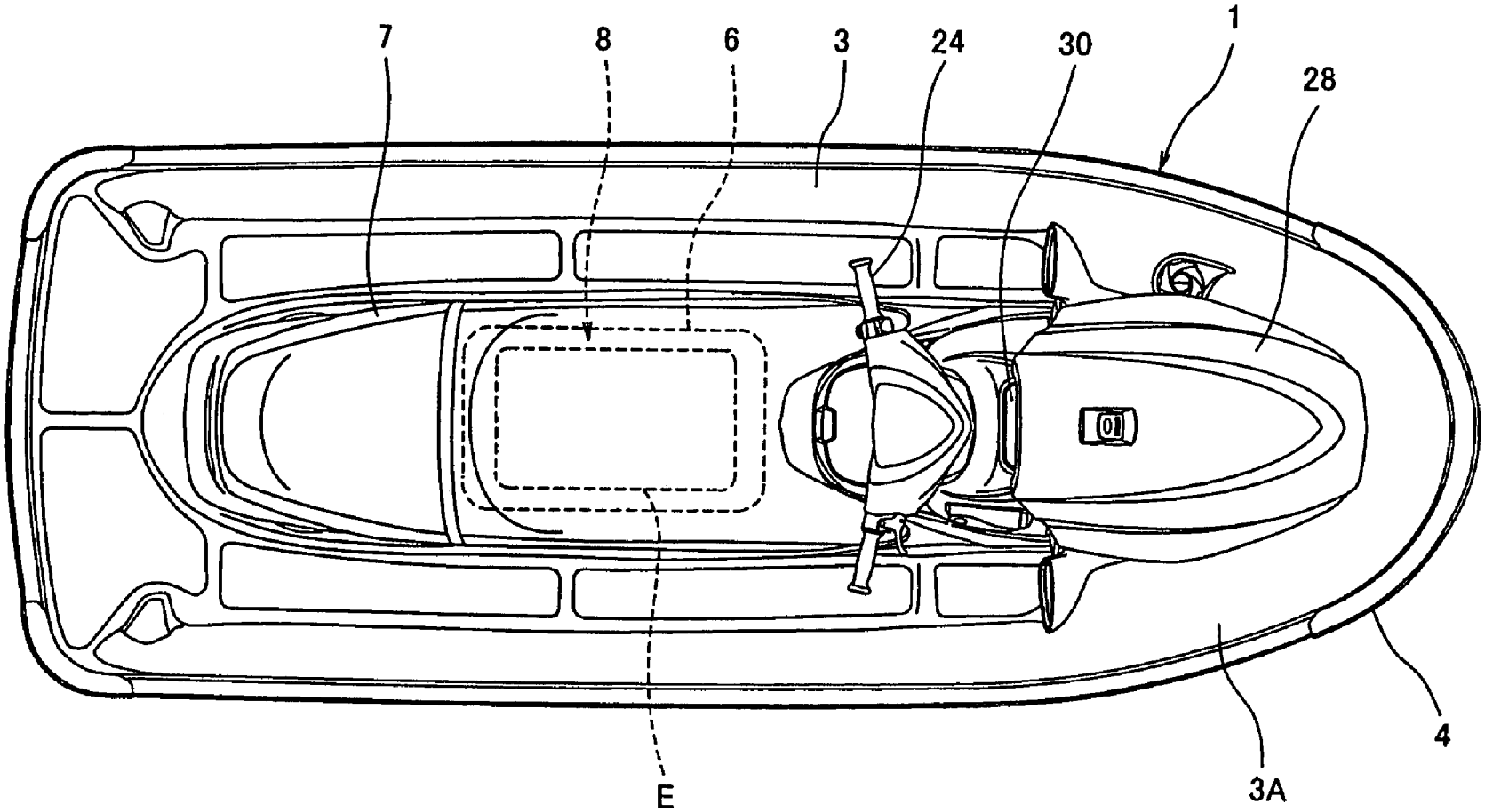
FIG. 2 is a plan view of the personal watercraft of FIG. 1.

As shown in FIG. 2, a deck opening 6, which has a substantially rectangular shape as seen from above, is formed at a substantially center section of the deck 3 in the upper portion of the body 1 such that its longitudinal direction corresponds with the longitudinal direction of the body 1. The seat 7 is removably mounted over the deck opening 6. An engine room 8 is provided in a space defined by the hull 2 and the deck 3 below the deck opening 6. The engine room 8 has a convex-shaped transverse cross-section and is configured such that its upper portion is smaller than its lower portion. An engine. E is mounted within the engine room 8 and is configured to drive the watercraft. In this embodiment, the engine E is an in-line four-cylinder four-cycle engine.

As shown in FIG. 1, the engine E is mounted such that a crankshaft 9 extends along the longitudinal direction of the body 1. An output end of the crankshaft 9 is coupled to a propeller shaft 11 through a coupling device 10. The propeller shaft 11 is coupled to a pump shaft 12 of the water jet pump P mounted on the rear side of the body 1. The pump shaft 12 is configured to rotate integrally with the crankshaft 9. An impeller 13 is attached on the pump shaft 12. Fairing vanes 14 are provided behind the impeller 13. The impeller 13 is covered with a tubular pump casing 15 on the outer periphery thereof.

A water intake 17 is provided on the bottom of the body 1. The water intake 17 is connected to a front portion of the pump casing 15 through a water passage 18. A pump nozzle 19 is provided on the rear side of the body 1 and is coupled to a rear portion of the pump casing 15. The pump nozzle 19 has a cross-sectional area that is gradually reduced rearward, and an outlet port 20 is provided on the rear end of the pump nozzle 19.

In the above constructed personal watercraft, water outside the watercraft is sucked from the water intake 17 provided on the bottom of the hull 2 and is fed to the water jet pump P. The water jet pump P pressurizes and accelerates the water, and the fairing vanes 14 guide water flow behind the impeller 13. The water is ejected through the pump nozzle 19 and from the outlet port 20. As the resulting reaction, the watercraft obtains a propulsion force.

A steering device 100 is located forward of the seat 7 and is configured to determine a steering direction or the like of the watercraft. The steering device 100 includes a steering column 23 configured to extend rearward and upward through an inside of the deck 3 and to protrude upward from the deck 3, and further includes a bar-type steering handle 24 attached to an upper end portion of the steering column 23. A lower end portion of the steering column 23 is coupled to a steering nozzle 25 provided behind the pump nozzle. 19 through a cable (not shown). When the rider rotates the handle 24 clockwise or counterclockwise, the steering nozzle 25 pivots toward the opposite direction so that the ejection direction of the water being ejected through the pump nozzle 19 can be changed, and the watercraft can be correspondingly turned to any desired direction while the water jet pump P is generating the propulsion force.

As shown in FIG. 1, a bowl-shaped reverse deflector 26 is provided on the rear side of the body 1 and on an upper portion of the steering nozzle 25 such that it is vertically pivotable around a pivot shaft 27 that is oriented horizontally. When the deflector 26 is pivoted downward around the pivot shaft 27 to be positioned behind the steering nozzle 25, the water ejected from the steering nozzle 25 collides against an inner surface of the deflector 26 and is thereby directed substantially forward. Thereby, the watercraft is propelled rearward.

As shown in FIGS. 1 and 2, a display panel 30 is provided in the vicinity of and in front of the steering handle 24. The display panel 30 is configured to display various information such as a travel speed, a fuel remaining amount, etc. A hatch cover 28 is provided on a forward deck portion 3A of the deck 3 that is located forward of the steering handle. 24 so as to extend from a fore region to a region immediately before the handle 24. The hatch cover 28 is pivotally mounted around a front end portion thereof in the vicinity of the fore region. A pivot operation of the hatch cover 28 is facilitated by a spring and clamper mechanism (not shown). A rear end portion of the hatch cover 28 extends to a region above the display panel 30. The hatch cover 28 also serves as a visor of the display panel 30.

Figure 3:
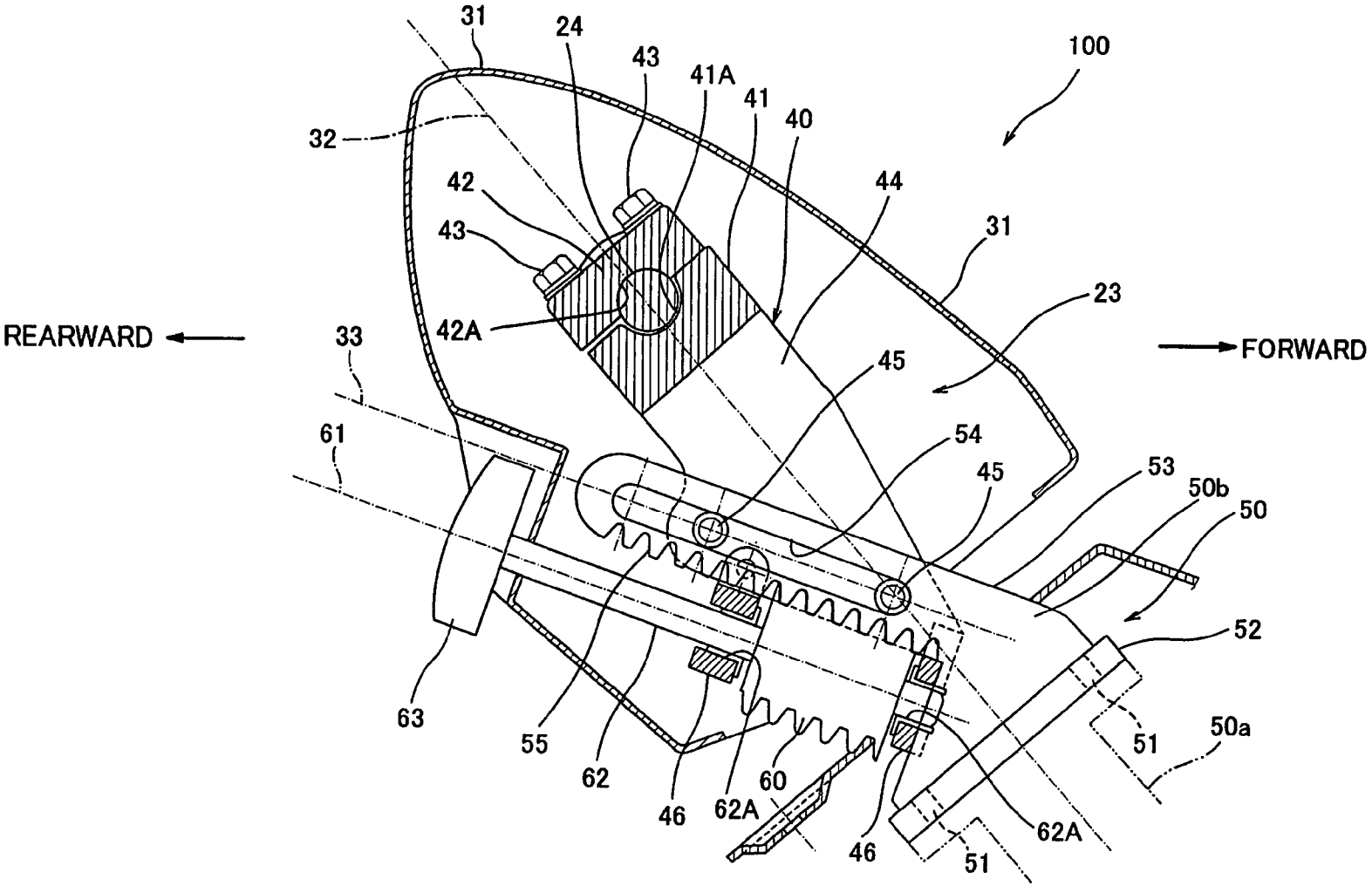
FIG. 3 is a partially enlarged view, partly in section, of a construction of a steering device of the personal watercraft of FIGS. 1 and 2, illustrating the retracted state of the steering column.

As shown in FIG. 1, the steering column 23 is provided to be inclined rearward at a predetermined angle with respect to a vertical direction. FIG. 3 is a view, partly in section, of a construction of the steering device 100, including the steering column 23. As shown in FIG. 3, the steering column 23 includes an upper steering column 40 configured to support the steering handle. 24 extending in a lateral direction of the body 1 and configured to be covered with a column cover 31. The steering column 23 further includes a lower steering column 50 located under the upper steering column 40. As described later, the upper steering column 40 is movably coupled to the lower steering column 50.

The lower steering column 50 includes a cylindrical portion 50*a* (indicated by a two-dotted line in FIG. 3) that is supported by the forward deck portion 3A (FIG. 1) or its internal elements to be rotatable around a rotational axis 32, and a joint portion 50*b* mounted to an upper portion of the cylindrical portion 50*a*. The joint portion 50*b* is substantially an inverted-T shape as viewed from the front. A flat flange portion 52 having a plurality of mounting holes 51 is provided at a lower portion of the joint portion 50*b*. Bolts are threaded into the mounting holes 51 to fasten the flange portion 52 to the cylindrical portion 50a. An elongate engagement plate 53 is provided to extend vertically from the flange portion 52.

As shown in FIG. 3, the engagement plate. 53 of the lower steering column 50 is provided with an elongate guide hole 54 configured to open in the lateral direction and to extend along an imaginary straight line 33 extending to be inclined rearward with respect to the rotational axis 32. The engagement plate 53 is provided on a back portion thereof, with a worm rack 55 that has a number of teeth arranged in parallel with the imaginary straight line 33. In this embodiment, the worm rack 55 extends over a substantially entire region of the back portion of the engagement plate. 53.

The upper steering column 40 is two-forked as viewed from the front. A groove 41A with a semi-circular cross-section is provided on an upper surface of an upper end portion 41 of the steering column 40 so as to extend in the lateral direction. The steering handle 24 extends in the lateral direction and its center region is fitted to the groove 41A. A block 42 provided with a groove 42A on a lower surface thereof is placed on the upper surface of the upper end portion 41 of the upper steering column 40 and is fastened to the upper end portion 41 of the upper steering column 40 by a plurality of fasteners 43, and is configured to hold the steering handle 24.

Two protruding portions 45 are provided in the vicinity of lower end portions of two-forked right and left side wall portions 44 of the upper steering column 40 (in FIG. 3, left side wall portion is illustrated). The protruding portions 45 are configured to extend inward and are arranged to be spaced a predetermined distance apart from each other along the imaginary straight line 33. The upper steering column 40 is placed such that the right and left side wall portions 44 sandwich the engagement plate 53 of the lower steering column 50. The protruding portions 45 are inserted into the elongate guide hole 54 of the lower steering column 50 and are guided to move along the elongate guide hole 54, i.e., along the imaginary straight line 33.

A worm screw 60 is pivotally mounted to a lower end portion of the side wall portion 44 of the upper steering column 40 and is configured to mesh with a worm rack 55 of the lower steering column 50. A shaft portion 62 is fixedly provided on the worm screw 60 so as to extend through an inside of the worm screw 60 concentrically with a rotational axis. 61 of the worm screw 60. The shaft portion 62 is pivotally mounted to the side wall portion 44 of the upper steering column 40 at two locations in the vicinity of the worm screw 60 by two brackets 46 and sleeves 62A that are mounted at a lower end portion of the side wall portion 44 such that the shaft portion 62 is rotatable around the rotational axis 61, and is axially unmovable. In this state, the worm screw 60 is in mesh with the worm rack 55 with the rotational axis 61 extending in parallel with the imaginary straight line 33.

Figure 4:
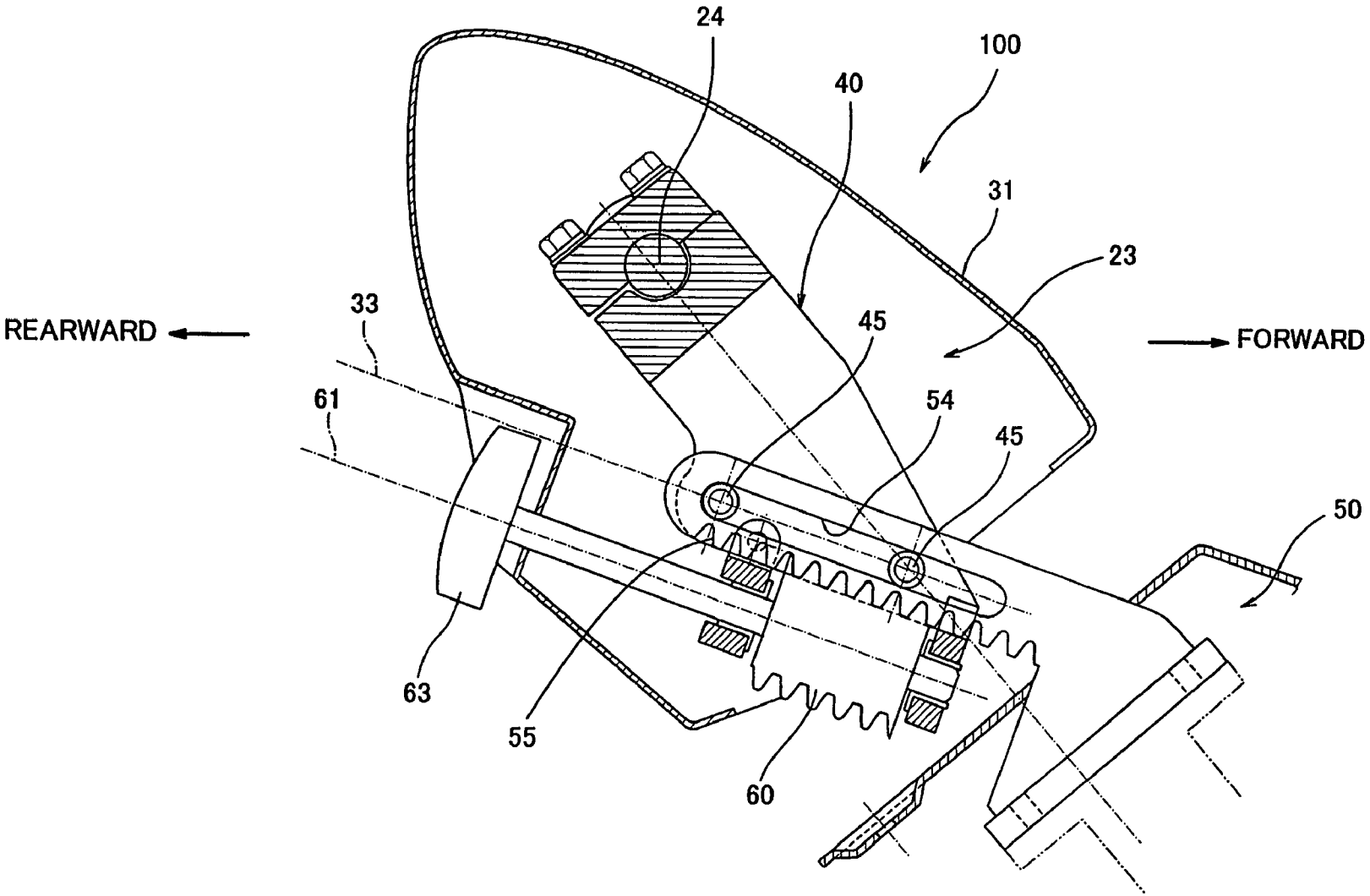
FIG. 4 is a view showing an extended state of the steering column of FIG. 3.

The shaft portion 62 extends upward and rearward from the worm screw 60 and through an inside of a rear portion of the column cover 31. A grip 63 is attached to an end portion of the shaft portion 62 that is located outside the column cover 31 and is configured to be rotated by the rider. FIG. 4 is a view, partly in section, of a construction of the steering device 100 with the upper steering column 40 positioned upward and rearward. When the grip 63 is rotated, the worm screw 60 rotates around the rotational axis 61 with the worm screw 60 in mesh with the worm rack 55. This causes the protruding portions 45 to be guided along the elongate guide hole 54, thereby allowing the upper steering column 40 to move together with the worm screw 60 between a forward and downward position (FIG. 3) and a rearward and upward position (FIG. 4).

The upper steering column 40 is configured not to move along the imaginary straight line 33 unless the grip 63 is rotated because the use of the worm screw 60 and the worm rack 55, which are in mesh with each other. As a result, the upper steering column 40 is held at a desired position without a need for an additional engagement mechanism.

Alternatively, the steering device 100 may be constructed such that the worm rack 55 is provided on the upper steering column 40 and the worm screw 60 is pivotally mounted to the lower steering column 50. In a further alternative, the elongate guide hole 54 may be provided in the upper steering column 40 and the protruding portions 45 may be provided on the lower steering column 50. In a further alternative, the elongate guide hole 54 configured to open in the lateral direction and to extend along the imaginary straight line 33 may be replaced by, for example, a groove that is concave in cross-section, so long as it is capable of guiding the protruding portions 45 in engagement state.

FIG. 1 illustrates the personal watercraft equipped with the above constructed steering device 100 in which the steering column 23 is retracted to the lowest position, i.e., the upper steering column 40 is located at the lowest position in the personal watercraft. The steering handle 24 is positioned suitably for, for example, the small rider R1. In this state, as shown in FIG. 3, the lower protruding portion 45 is in contact with a lowermost end portion of the guide elongate hole 54.

Figure 5:
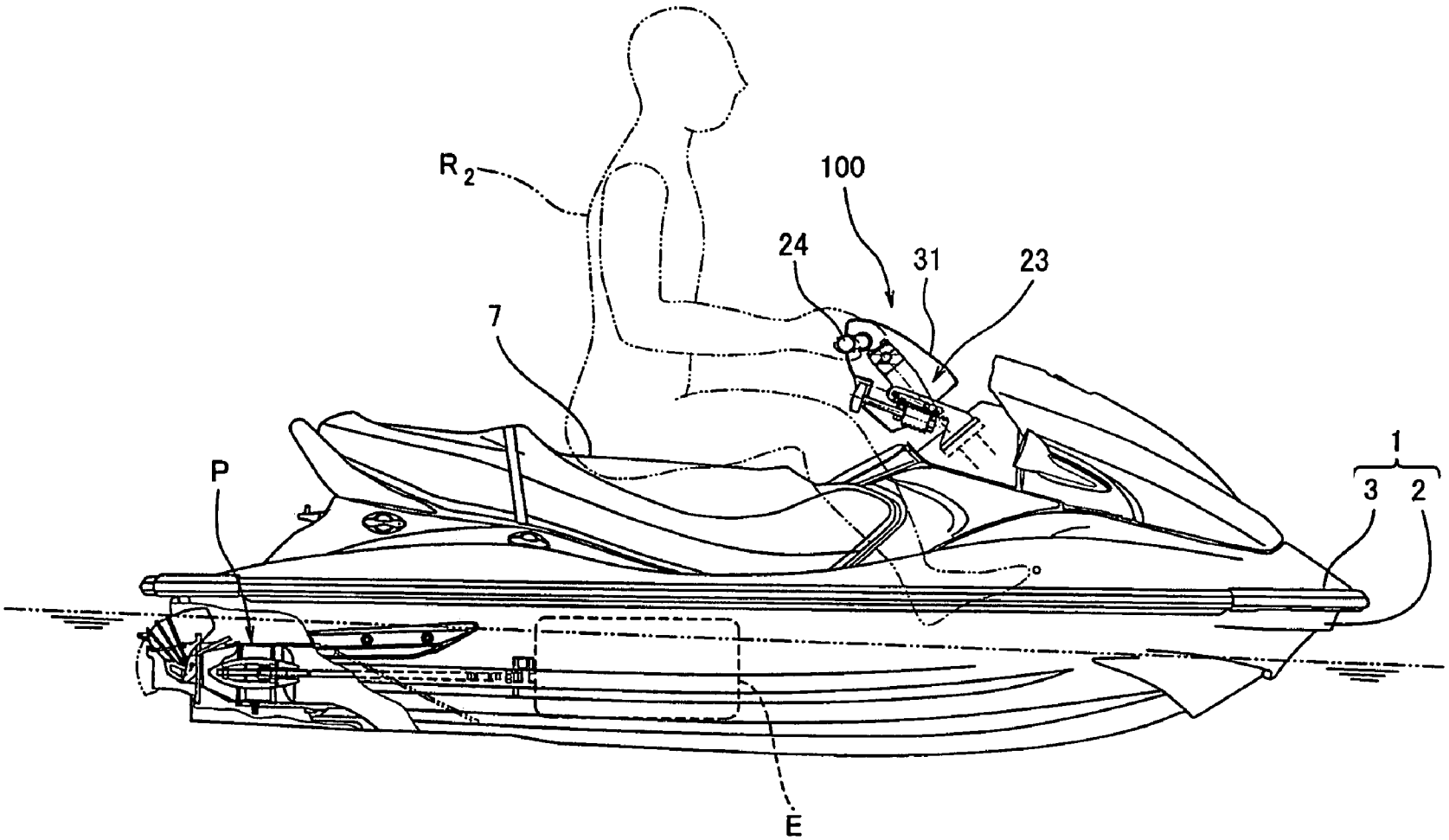
FIG. 5 is a side view of a personal watercraft according to an embodiment of the present invention, showing the extended state of the steering column and the steering attitude of the rider.

FIG. 5 illustrates the personal watercraft equipped with the above constructed steering device 100 in which the steering column 23 is extended to the highest position, i.e., the upper steering column 40 is located at the highest position in the personal watercraft. The steering handle 24 is positioned suitably for, for example, a large rider R2. In this state, as shown in FIG. 4, the upper protruding portion 45 is in contact with an uppermost end portion of the elongate guide hole 54.

Furthermore, since the upper steering column 40 is coupled to the lower steering column 50 with the engagement plate 53 of the lower steering column 50 sandwiched between the right and left wall portions 44 of the upper steering column 40 and the worm rack 55 of the lower steering column 50 sandwiched between the protruding portions 45 and the worm screw 60 of the upper steering column 40, the upper steering column 40 is firmly secured without moving in both longitudinal and lateral directions.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A steering device of a personal watercraft comprising:

a lower steering column that is mounted to a body of the watercraft and is configured to be rotatable around a rotational axis extending rearward and upward; and an upper steering column that is configured to support a steering handle and is movably coupled to the lower steering column;

wherein the upper steering column is movable close to and away from the lower steering column along a straight line extending to be inclined rearward with respect to the rotational axis of the lower steering column.

2. The steering device of a personal watercraft according to claim 1, wherein one of the upper steering column and the lower steering column is provided with an elongate guide hole configured to open in a lateral direction of the watercraft and to extend along the straight line extending to be inclined rearward with respect to the rotational axis of the lower steering column, and the other steering column is provided with a protruding portion configured to be guided along the straight line in engagement with the elongate guide hole; and wherein one of the upper steering column and the lower steering column is provided with a worm screw rotatably attached thereto, the worm screw being rotatable around a rotational axis extending substantially in parallel with the straight line extending to be inclined rearward with respect to the rotational axis of the lower steering column, and the other steering column is provided with a worm rack configured to extend along the straight line and to mesh with the worm screw.

3. The steering device of a personal watercraft according to claim 2, further comprising:

a column cover configured to cover the upper steering column; and a grip attached to an end portion of a shaft portion which is located outside the column cover, the shaft portion extending from the worm screw to outside the column cover along the rotational axis of the worm screw, the grip being configured to be rotated integrally with the worm screw to cause the upper steering column to be movable close to and away from the lower steering column.

* * * * *